US007611081B2

(12) United States Patent
Partee

(10) Patent No.: US 7,611,081 B2
(45) Date of Patent: Nov. 3, 2009

(54) ADAPTOR TO A FIRE NOZZLE THAT PRODUCES A REARWARD SAFETY SPRAY BUBBLE

(76) Inventor: Charles Howse Partee, P.O. Box 132, Aguila, AZ (US) 85320

( * ) Notice: Subject to any disclaimer, the term of this patent is extended or adjusted under 35 U.S.C. 154(b) by 86 days.

(21) Appl. No.: 11/510,184

(22) Filed: Aug. 24, 2006

(65) Prior Publication Data

US 2008/0060824 A1 Mar. 13, 2008

(51) Int. Cl.
*B05B 1/26* (2006.01)
*A62C 31/00* (2006.01)

(52) U.S. Cl. ..... 239/511; 169/45; 169/46; 239/443; 239/558; 239/576; 239/581.2

(58) Field of Classification Search ..... 169/45, 169/46; 239/443, 511, 515, 543, 550, 558, 239/576, 581.1, 581.2
See application file for complete search history.

(56) References Cited

U.S. PATENT DOCUMENTS

| | | | | |
|---|---|---|---|---|
| 1,823,277 | A * | 9/1931 | Lum | 239/441 |
| 2,570,828 | A * | 10/1951 | Martin | 239/443 |
| 2,678,847 | A * | 5/1954 | Caird | 239/456 |
| 2,928,611 | A * | 3/1960 | Lauderback et al. | 239/439 |
| 4,700,894 | A * | 10/1987 | Grzych | 239/555 |
| 5,351,891 | A * | 10/1994 | Hansen et al. | 239/248 |
| 6,354,320 | B1 * | 3/2002 | Kolacz et al. | 137/38 |

* cited by examiner

*Primary Examiner*—James S Hogan

(57) ABSTRACT

A cylindrical adapter to a fire nozzle is disclosed which produces not only a forward stream but also at the same time a second rearward directed safety spray cone shaped bubble which encloses the fireman and any persons or property being rescued. This adjustable cone shaped bubble protects the fireman by reducing the radiant heat felt by the fireman as well as dangerous gases. Also is taught a small pipe centered in the cylinder with the purpose to allow a shaft to be inserted therein. This shaft can be used to control the forward stream in future models of the invention.

2 Claims, 2 Drawing Sheets

ADAPTOR TO A FIRE NOZZLE THAT PRODUCES A REARWARD SAFETY SPRAY BUBBLE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of firefighting equipment and more specifically to an adaptor to a fire nozzle that produces a rearward cone shaped safety spray bubble.

BACKGROUND OF THE INVENTION

The standard fire fighting nozzle is coupled to the end of a hose, held by a fireman and directs a stream of water substantially, directly forward at the fire. A number of variations have been disclosed which address the problems of producing various spray patterns and are often referred to as fog nozzles. Fog nozzles for many years have been an important aid in fighting fires by controlling, to some extent, radiant heat, reducing the temperature of a blaze, limiting the amount of oxygen within an enclosed area, and displacing large quantities of combustible gases from a confined area.

Fog nozzles which produce a dispersed spray pattern have a wide variety of structures, but the peripheral jet fire nozzle is most commonly used, because it has the ability to discharge a large amount of water in a straight stream in one position of adjustment and a lessor amount of water in a fog spray in another position of adjustment, all of which are directed in the forward direction.

The inherent problem that exists with all of the known prior art is that the fireman must make a choice between and compromise between the often times more effective straight stream mode which places a large amount of unrestricted water on the fire but which leaves the radiant heat and large quantities of combustible gases un-contained to pose a real danger to the fireman, or the fog mode which more effectively protects the fireman from radiant heat and gases but reduces the amount of water reaching the heart of the blaze.

In the peripheral jet nozzle one common means for producing the rearward fog spray comprises providing a row of equally spaced fixed teeth having a flat face in a circular ring at the discharge end of the nozzle in the path of a conical jet of water issuing forwardly from the interior of the nozzle. However, when the water strikes the face of each tooth, it deflects along the same line as the face of the tooth and the spray pattern consists of a conical row of small spaced jets, creating a gap in the outer conical spray pattern for each tooth. Likewise, there is a gap in the inner spray pattern between each jet of water. The characteristic "fingers" in the spray pattern are objectionable, because they permit radiant heat and gases to pass through the spray pattern. U.S. Pat. No. 4,653,693 addresses the problem of the "fingers" by forming an inner and outer spray pattern to form a single fully filled dispersed forward fog cone having a wide angle of divergence and a circumference free of gaps however, in this mode, the cone of water may provide a better protection for the fire fighter but no forward straight stream mode is provided. Also it can be noted that all the former art makes no effort to reduce in any way the reactive rearward force generated by the forward spray or stream. With larger nozzles this force often requires more than one man to control the hose and nozzle.

It is desirous, then, to provide a dual system which can not only produce forward straight stream but can at the same time produce a backward fog cone to arrest the radiant heat and gases and protect the fireman and persons or property being rescued while at the same time reducing the reactive rearward force generated by the forward stream or fog spray. Furthermore, it can be noted that in a dangerous rescue mode the forward fog can be deployed as well as the rearward cone offering further protection to the fireman and persons or property being rescued.

BRIEF SUMMARY OF THE INVENTION

In accordance with a preferred embodiment of the invention, there is disclosed an adaptor to a fire nozzle that produces a rearward conical safety spray bubble that completely encloses the fireman and persons or property being rescued thus protecting them from the radiant heat and noxious gasses while at the same time allowing for the use of the normal forward facing stream or fog cone employed by most fire fighting nozzles.

ADVANTAGES OF THE INVENTION

The primary advantage of the invention is a rearward conical spray bubble that completely encloses the fireman and persons or property being rescued while at the same time allowing the fireman to deploy the normal forward stream at the fire. Another advantage of the invention is that this rearward conical spray bubble reduces the temperature felt by the fireman.

A further advantage of the invention is that this rearward conical spray bubble cleans the air experienced by persons or property inside the bubble.

Yet another advantage of the invention is a generated reactive forward force that helps the fireman control the hose and nozzle.

Other objects and advantages of the present invention will become apparent from the following descriptions, taken in connection with the accompanying drawings and specifications.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

DETAILED DESCRIPTION OF THE FIGURES

Figure 1:
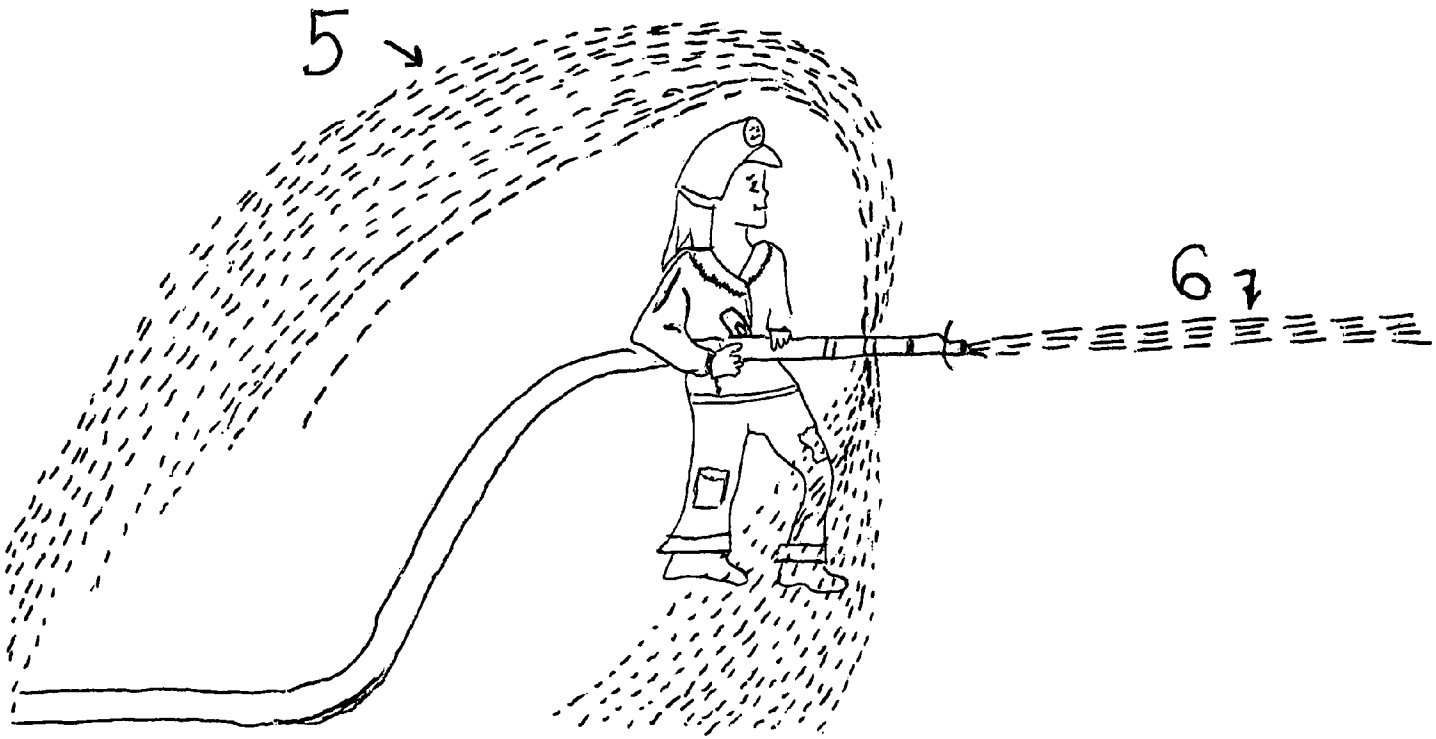
FIG. 1 is an elevational view of the invention being operated by a fireman displaying a forward stream and the rearward cone shaped safety spray bubble.

Referring now in detail to the drawings wherein like characters refer to like figures throughout the drawings, FIG. 1 shows a fireman using the invention in the typical mode with the forward stream 6 and the rearward cone shaped safety spray bubble number 5. It can be noted that the fireman is completely enclosed in the bubble and is protected in every direction by the spray and at the same time having very little of the spray actually touching him. This rearward spray bubble also produces a reactive force in the forward direction which acts to reduce the backward reactive force of the forward stream, thus aiding the fireman in physically controlling the hose and nozzle. In all the past art it can be seen that the fireman is deploying only one of the two options available to him all of which are in the forward direction. In this invention both the forward stream 6 or a forward fog cone [not shown] can be deployed at the same time with the rearward cone shaped bubble. With the rear-ward cone deployed the fireman and persons or property inside the bubble are protected against the radiant heat and the noxious gasses normally encountered in a fire.

Figure 2:
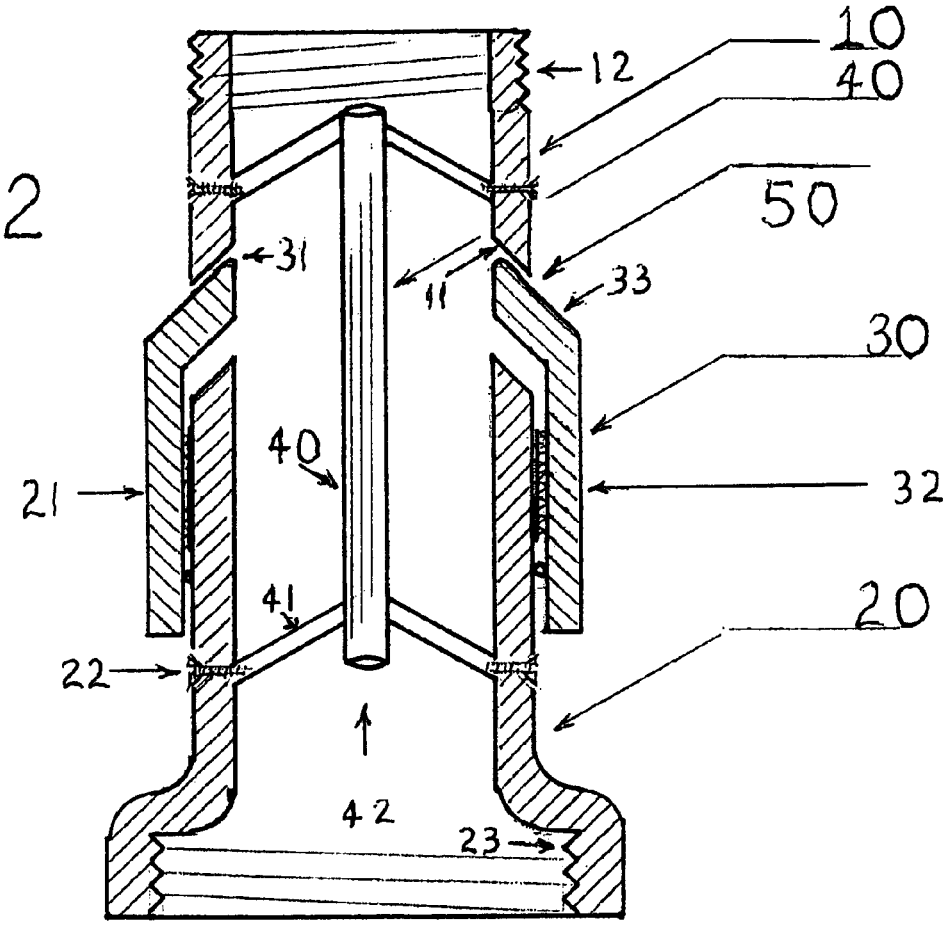
FIG. 2 is a cross sectional view of the cylinder showing all the various parts.

FIG. 2 is a sectional view of the cylinder with male threads 12 sized for a fire nozzle on the forward end part 10 and female threads on the rear end part 20 sized for a fire hose. Liquid, normally water, flows from the rear end part 20 toward the forward end part 10 as depicted by the arrow 42. Said cylinders are supported and held together by part 40 which is a small pipe having support brackets 41 which are mounted internally with screws 22 which facilitate assembly and disassembly.

Figure 3:
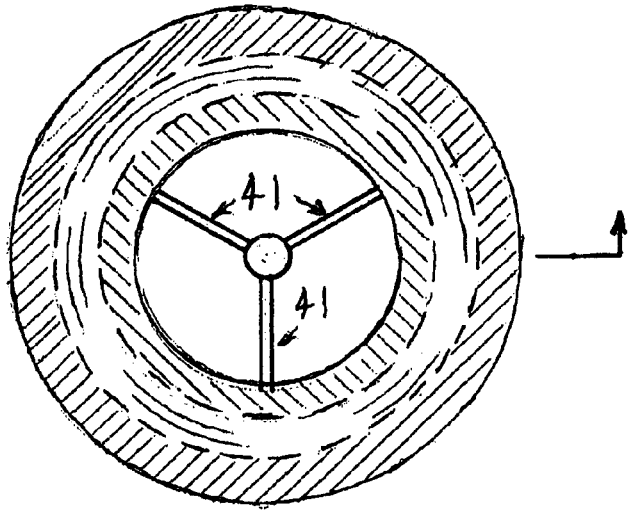
FIG. 3 is an end view of the cylinder showing the center support brackets.

Part 10 has an angle cut 11 which forms the front half of the slot 50 which produces the rearward spray bubble 5 in FIG. 1. Part 20 is the rearmost part of the cylinder part of the cylinder with female threads 23 sized to fit a hose and having external threads 21 which cooperate with the threads 32 on part 30. Part 30 is a sleeve which rotates axially on part 20 so as to open or close the slot 50 thus controlling the slot 50 thus controlling the width of the rearward cone shaped bubble at the discretion of the fireman. Also part 30 has a slightly rounded tip 31 on the angle cut 33 which acts to increase the speed of the liquid flowing through slot 50 thus aiding the volume, size and shape of the cone shaped bubble 5. FIG. 3 is an end view of the cylinder showing the web brackets 41.

It will now be seen that we have provided a new and unique adapter to a conventional fire nozzle that can fit between the fire hose and any conventional fire nozzle of choice with the adapter producing a controllable rearward cone shaped safety spray bubble controllable at the option of the firefighter which will protect him and persons or property being rescued against the radiant heat and noxious gasses while at the same time using the straight forward stream with the added benefit that the rearward spray helps him in physically controlling the hose.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described my invention, what I claim as new and desire to secure by Letters Patent is:

1. An adaptor to a fire nozzle that produces a rearward safety spray bubble comprising:

a cylinder assembly comprising;

a rear end part threaded to accept an existing fire hose on a rear end and;

a forward end part, threaded to accept an existing fire nozzle on a front end, said rear end part and said forward end part supported by an internal small pipe having support brackets mounted internally to both said rear end part and forward end part resulting in the formation of;

a 360 degree circular slot between said rear end part and front end part, angled facing the rear end part, and a sleeve threadably and axially mounted onto said rear end part between said rear end part and said front end part and partially within said 360 degree circular slot between said rear end part and said front end part, said formed slot having a size that can be controlled by rotating said sleeve so as to produce a larger or smaller slot and thus a controllable rearward cone shaped spray bubble when water or other fire extinguishing mediums are applied under pressure.

2. An adaptor as claimed in claim 1 where in the sleeve forming the opening is slightly rounded which causes an increase in the speed of the liquid passing through the slot.

* * * * *